US006082324A

United States Patent [19]

Liu

[11] Patent Number: 6,082,324

[45] Date of Patent: Jul. 4, 2000

[54] ROTARY INTERNAL COMBUSTION ENGINE

[76] Inventor: Nien-Tzu Liu, 5th Fl., No. 16, Lane 34, Sec. 2, Acadymic Rd., Taipei, Taiwan

[21] Appl. No.: 09/148,767

[22] Filed: Sep. 5, 1998

[51] Int. Cl.[7] ..... F02B 53/00

[52] U.S. Cl. ..... 123/235; 123/236; 418/268

[58] Field of Search ..... 123/235, 236; 418/259, 268

[56] References Cited

U.S. PATENT DOCUMENTS

| | | | |
|---|---|---|---|
| 1,792,026 | 2/1931 | Nichols | 123/235 |
| 1,877,250 | 9/1932 | Meyer | 123/235 |
| 1,909,880 | 5/1933 | Meyer | 123/235 |
| 2,878,793 | 3/1959 | Birk | 123/236 |
| 3,884,196 | 5/1975 | Grob et al. | 123/235 |

FOREIGN PATENT DOCUMENTS

| | | | |
|---|---|---|---|
| 1260120 | 3/1961 | France | 123/236 |
| 122861 | 10/1927 | Switzerland | 123/236 |
| 26118 | 1/1911 | United Kingdom | 123/235 |
| 12238 | 4/1912 | United Kingdom | 123/235 |

*Primary Examiner*—Michael Koczo

*Attorney, Agent, or Firm*—W. Wayne Liauh

[57] ABSTRACT

Disclosed is a rotary internal combustion engine of which all operations are circular motions and therefore energy consumed for mechanical transmission is reduced and power output is continuous and stable. The rotary internal combustion engine mainly includes an intake-compression chamber, an exhaust-power chamber, and a combustion chamber that has an intake port and an exhaust to communicate with the intake-compression chamber and the exhaust-power chamber, respectively. Two pairs of rotors and rotational valve plates are separately provided in the intake-compression chamber and the exhaust-power chamber to mount around a power output shaft extending through the two chambers, so that the rotors, the valve plates, and the power output shaft rotate synchronously. When the valve plates rotate with valve holes provided thereon separately overlapping the intake port and the exhaust port of the combustion chamber, either compressed air in the intake-compression chamber is compressed into the combustion chamber for combustion, or burned and exploded gas in the combustion chamber is released into the exhaust-power chamber to rotate the power output shaft. The rotary internal combustion engine has simplified peripheral mechanisms and reduced volume while it has increased thermal efficiency and enhanced power output.

6 Claims, 8 Drawing Sheets

PRIOR ART FIG.1A

PRIOR ART FIG.1B

PRIOR ART FIG.1C

PRIOR ART FIG.1D

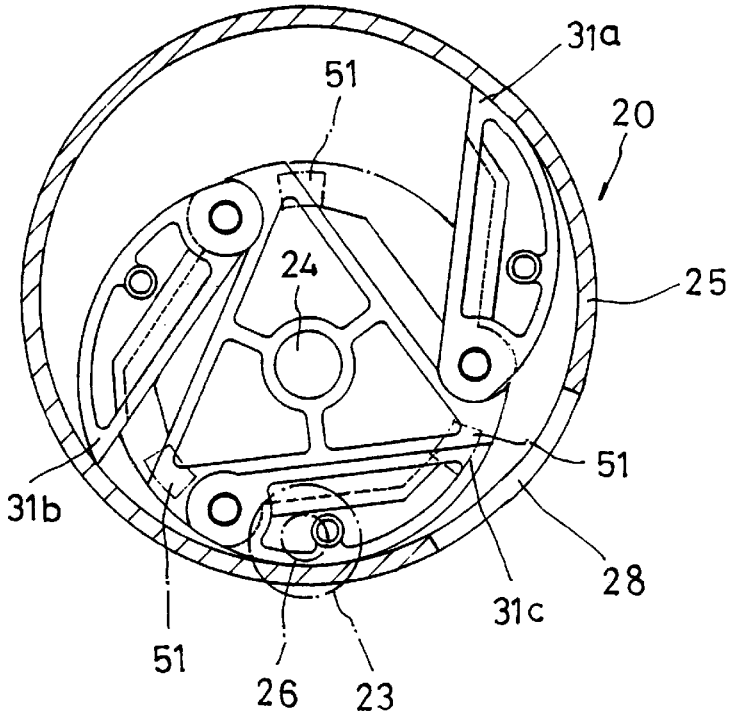
FIG·3C
FIG·3D
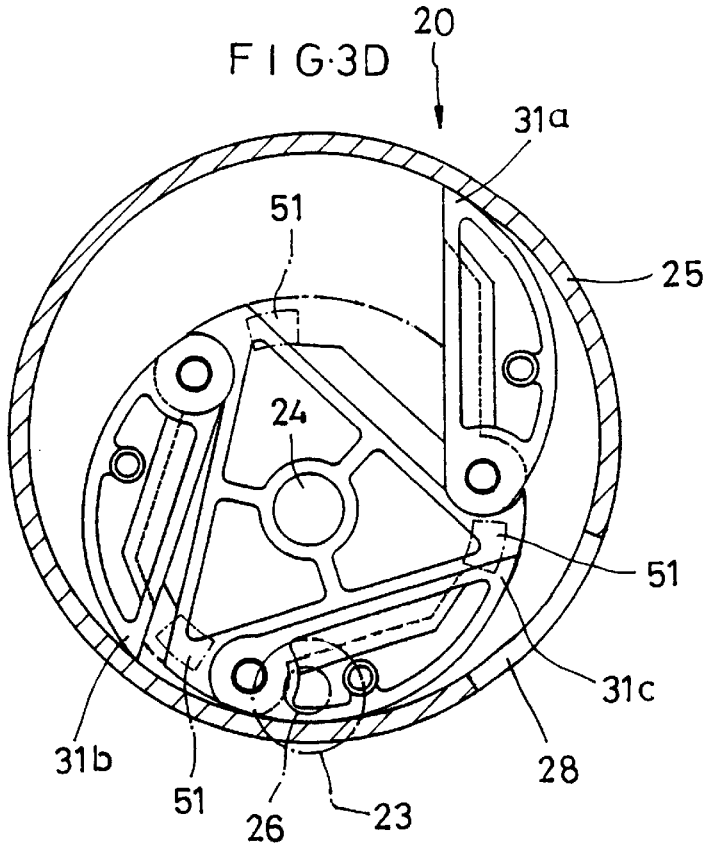

ROTARY INTERNAL COMBUSTION ENGINE

BACKGROUND OF THE INVENTION

The present invention relates to a rotary internal combustion engine, and more particularly to an internal combustion engine that has simplified peripheral mechanisms and reduced volume while it has increased thermal efficiency and enhanced power output.

In a conventional four-stroke reciprocating internal combustion engine, one single cylinder and a piston therein together define a space in which the piston moves forward or backward in rectilinear motions. And, the cylinder is provided at top portion with intake and exhaust valves to timely open or close. Each work cycle includes four strokes, namely, induction, compression, explosion, and exhaust. For an ordinary auto engine, four of such conventional internal combustion engines (cylinders) are needed to drive a car. As shown in FIGS. 1A to 1D, the conventional internal combustion engine has a piston 10 which moves forward and backward to rotate a crank 12 via a connecting rod 11, so that power is output via a crank shaft 13. In FIG. 1A, the conventional internal combustion engine is in an intake state. In this state, the piston 10 moves downward, the intake valve 14 opens and the exhaust valve 15 closes, so that air is induced into the cylinder 16. In FIG. 1B, the conventional internal combustion engine is in a compression state. In this state, the piston 10 moves upward, both the intake valve 14 and the exhaust valve 15 are closed, so that air and fuel mixture in the cylinder 16 is compressed. In FIG. 1C, the internal combustion engine is in an explosion state. In this state, the intake valve 14 and the exhaust valve 15 are still closed. A plug 17 is ignited to cause the air and fuel mixture to explode in the cylinder 16 and thereby pushes the piston 10 downward. At this point, a power is generated to drive the crank 12 to move. In FIG. 1D, the internal combustion engine is in an exhaust state. In this state, the piston 10 moves upward, the intake valve 14 closes and the exhaust valve 15 opens, so that exhaust produced after explosion and combustion is discharged from the cylinder 16 via the exhaust valve 15. In the above four strokes of induction, compression, explosion and exhaust, each stroke causes the crank shaft 13 to turn 180 degrees (that is, one half circle). The four strokes together cause the crank shaft 13 to turn total 720 degrees (that is, two circles). Only the turning of 180 degrees of the crank shaft 13 in the explosion stroke generates driving power. And, in the explosion stroke, the reciprocating rectilinear motions of the piston 10 is converted into circular motions only via the crank 12. That is, power can be most effectively output in a tangential direction only when the crank 12 is in a 90-degree position. Therefore, the conventional internal combustion engine has only limited working efficiency due to its structure, and power generated by the burned and exploded gas can not be fully utilized.

To maintain continuous output of power and to balance vibration during operation, the conventional four-stroke reciprocating internal combustion engine requires multiple cylinders, and therefore, it has increased volume and weight. Moreover, to enable the intake and the exhaust valves at the top of the cylinder to timely open and close during the operation of the internal combustion engine, other components, such as rotating shafts, cams, time control means (cogged belt), are needed and therefore make the conventional internal combustion engine have very complicate peripheral mechanisms. These complicate peripheral mechanisms also consume a part of power to work and therefore further reduce the thermal efficiency of the internal combustion engine.

SUMMARY OF THE INVENTION

It is therefore a primary object of the present invention to provide a rotary internal combustion engine of which all operations are in the form of circular motions. The rotary internal combustion engine has rotors in intake and exhaust chambers to directly associate with a power output shaft, therefore, no energy is consumed for mechanical transmission of power, and power can be continuously and stably output.

Another object of the present invention is to provide a rotary internal combustion engine that controls the intake and exhaust via blades on the rotors and therefore does not require any complicate peripheral mechanical mechanisms. That is, the rotary internal combustion engine has simplified structure.

The rotary internal combustion engine according to the present invention mainly includes an intake-compression chamber, an exhaust-power chamber, and a combustion chamber communicating with the first two chambers via an intake and an exhaust port, respectively. Rotors and rotational valve plates are provided in the intake and the exhaust chambers to rotate synchronously. When the valve plates rotate with valve holes provided thereon separately overlapping the intake port and the exhaust port of the combustion chamber, either compressed air in the intake-compression chamber is compressed into the combustion chamber for combustion, or burned and exploded gas in the combustion chamber is released into the exhaust-power chamber to rotate the power output shaft.

BRIEF DESCRIPTION OF THE DRAWINGS

FIGS. 3A, 3B, 3C, 3D and 3E sequentially illustrate the movements of a rotor in the intake-compression chamber of the present invention;

DETAILED DESCRIPTION OF THE PREFERRED EMBODIMENTS

Figure 1:
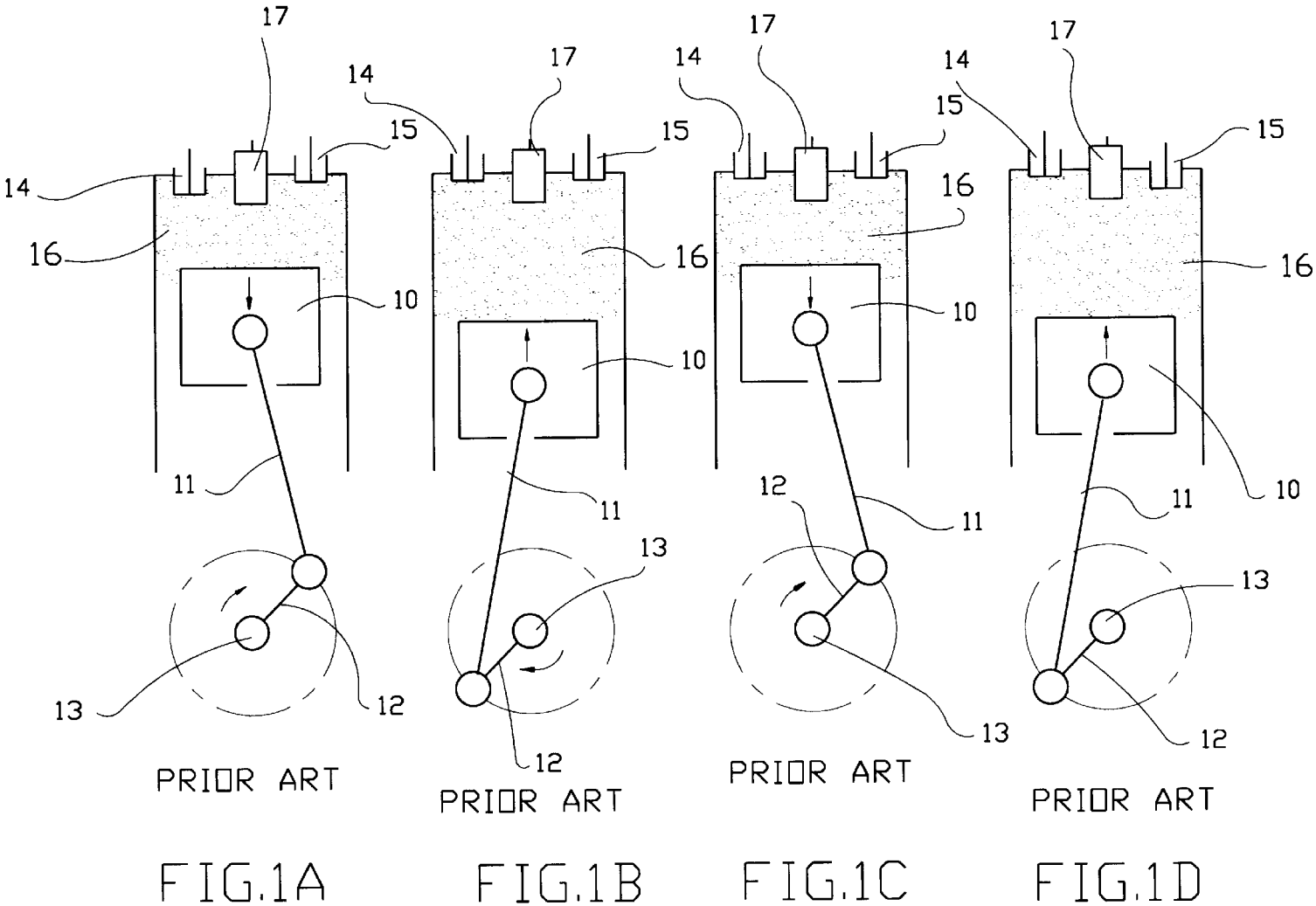
FIGS. 1A, 1B, 1C and 1D illustrate the induction, compression, explosion, and exhaust of a conventional four-stroke-cycle internal combustion engine.
Figure 2:
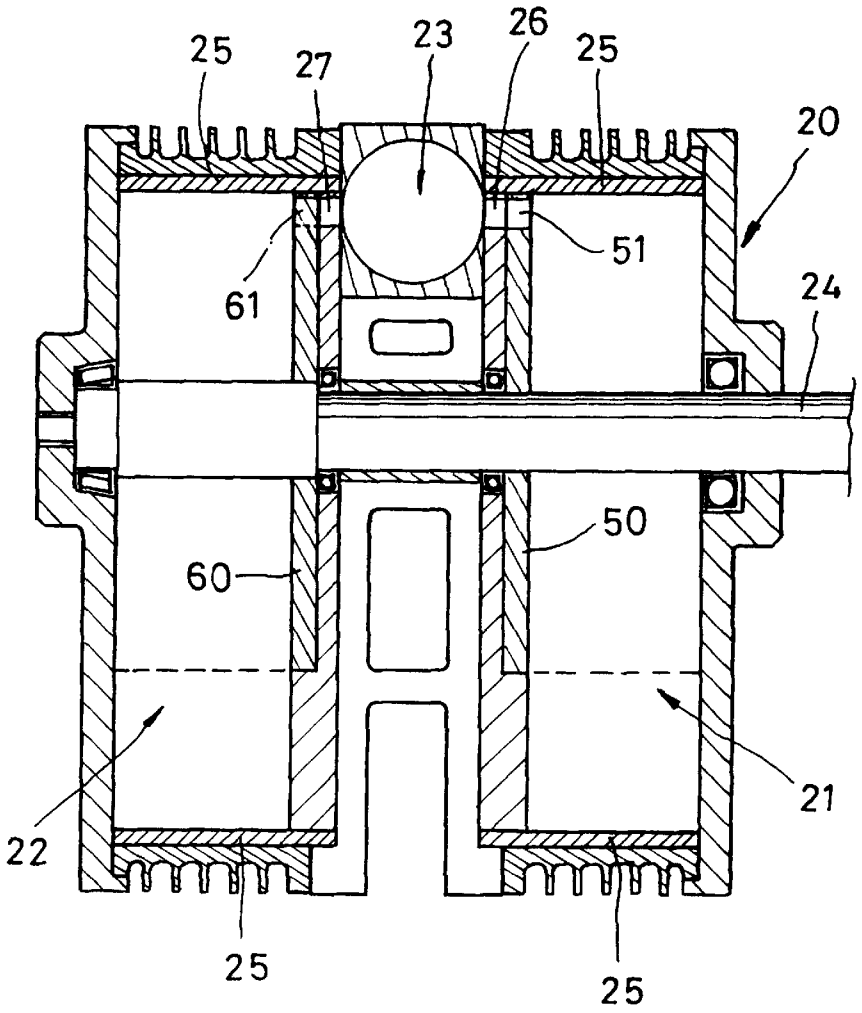
FIG. 2 is a cross sectional view of a rotary internal combustion engine according to the present invention.

Please refer to FIG. 2 that is a cross sectional view of a rotary internal combustion engine according to the present invention. As shown, the engine includes a cylinder 20 in which an intake-compression chamber 21, an exhaust-power chamber 22, and a combustion chamber 23 are formed. A power output shaft 24 transversely extends through the intake-compression chamber 21 and the exhaust-power chamber 22. A first rotor 30 and a first rotational valve plate 50 are provided in the intake-compression chamber 21 to fixedly mount around the power output shaft 24. A second rotor 40 and a second rotational valve plate 60 are provided in the exhaust-power chamber 22 to fixedly mount around the power output shaft 24. Three first blades 31*a*, 31*b*, and 31*c* are separately pivotally connected at one end to vertexes of three angles of the first rotor 30 such that they are equiangularly spaced along an outer periphery of the rotor 30 with another free end of each blade located after the pivotal end of a preceding blade. Similarly, three second blades 41*a*, 41*b*, and 41*c* are separately pivotally connected at one end to vertexes of three angles of the second rotor 40 such that they are equiangularly spaced along an outer periphery of the rotor 40 with another free end of each blade located after the pivotal end of a preceding blade. All these blades 31*a*, 31*b*, 31*c*, 41*a*, 41*b*, and 41*c* have a smoothly curved outer surface, whereby when the first and second rotors 30 and 40 rotate, the outer surfaces of these blades come into tangent contact with inner surface of a cylinder wall 25 under a centrifugal force. Such tangent contact of the blade outer surfaces with the inner surface of the wall 25 allows the intake-compression chamber 21 and the exhaust-power chamber 22 to be respectively divided into three separated and sealed spaces.

The combustion chamber 23 is provided with an intake port 26 to communicate with the intake-compression chamber 21, and an exhaust port 27 to communicate with the exhaust-power chamber 22. The first and second rotational valve plates 50 and 60 are formed of three valve holes 51 and 61, respectively. When the valve plates 50, 60 rotate about the power output shaft 24 and one of their three valve holes 51, 61 becomes overlapping the intake port 26 and the exhaust port 27, respectively, compressed air in the intake-compression chamber 21 is admitted into the combustion chamber 23 and burned and exploded air in the combustion chamber 23 is admitted into the exhaust-power chamber 22 to rotate the power output shaft 24, respectively.

Figure 5:
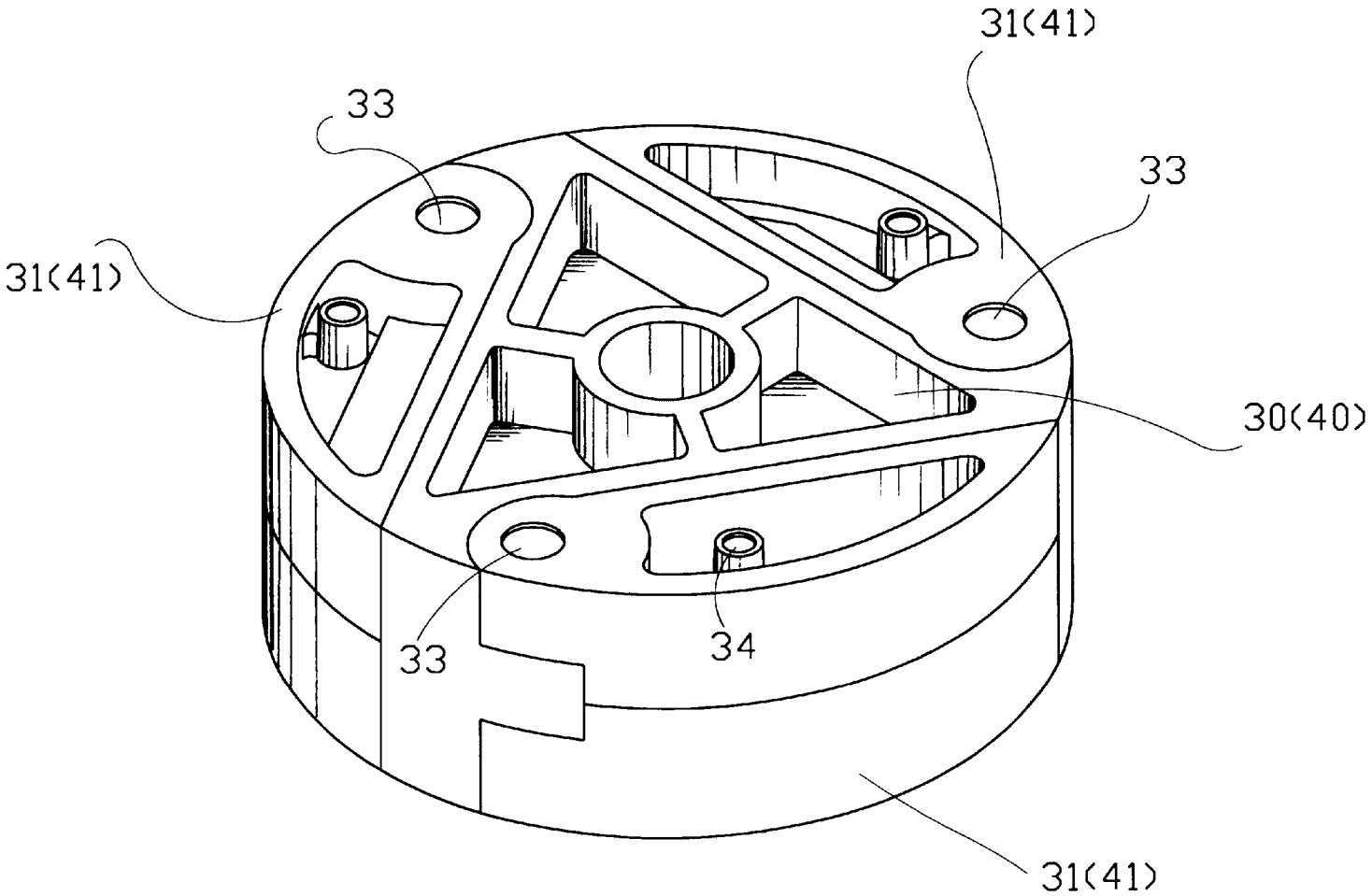
FIG. 5 is a perspective view of the rotor of FIG. 4 with blades assembled to it.

The power output shaft 24 is mounted at a position offsetting from a common center line of the intake-compression chamber 21 and the exhaust-power chamber 22, such that when the first or the second rotor 30 or 40 rotates to pass by a point on the cylinder wall 25 at where a distance between the wall 25 and a shaft center of the rotor 30 or 40 is shortest than at any other point on the wall 25, a point located at outer end of a maximum external diameter of the rotor 30 or 40 will come into airtightly tangent contact with the wall 25. When the blades 31*a*, 31*b*, 31*c* and 41*a*, 41*b*, 41*c* all are completely in close contact with the first and the second rotor 30 and 40, respectively, main bodies of the rotors 30, 40 and the smoothly curved outer surfaces of their respective blades together form a circular unit, as shown in FIG. 5. When the first and second rotors 30, 40 respectively rotate in the intake-compression chamber 21 and the exhaust-power chamber 22, the cylindrical wall 25 of the cylinder 20 defines the maximum distance to which the blades 31*a*, 31*b*, 31*c*, 41*a*, 41*b*, 41*c* can reach. In each turn of the rotor 30 or 40, the free end of each of these blades will be pivotally thrown out from the rotor 30 or 40 under centrifugal force and then return to a home position closely contacting with the main body of the rotor 30 or 40 in a cyclic manner.

When the first rotor 30 rotates in the intake-compression chamber 21, the free ends of the three blades 31*a*, 31*b* and 31*c* pivotally connected to the rotor 30 will be thrown out under centrifugal force to tangentially contact with the cylinder wall 25 and therefore divide the intake-compression chamber 21 into three separated spaces. The first rotational valve plate 50 and the first rotor 30 rotate synchronously. The three valve holes 51 on the rotational valve plate 50 are separately formed at positions corresponding to points on the first rotor 30 at where the free ends of the blades 31*a*, 31*b*, and 31*c* closely contact with the main body of the rotor 30. Moreover, when the first rotational valve plate 50 rotates along with the first rotor 30, there are times the three valve holes 51 are moved into points overlapping the intake port 26 of the combustion chamber 23. When any one of the three valve holes 51 on the rotational valve plate 50 overlaps the intake port 26, one of the three blades 31*a*, 31*b* or 31*c* corresponding to that valve hole 51 is also in a home position of completely closely contacting with the main body of the first rotor 30. At this point, compressed air is completely sent into the combustion chamber 23.

Figure 3A:
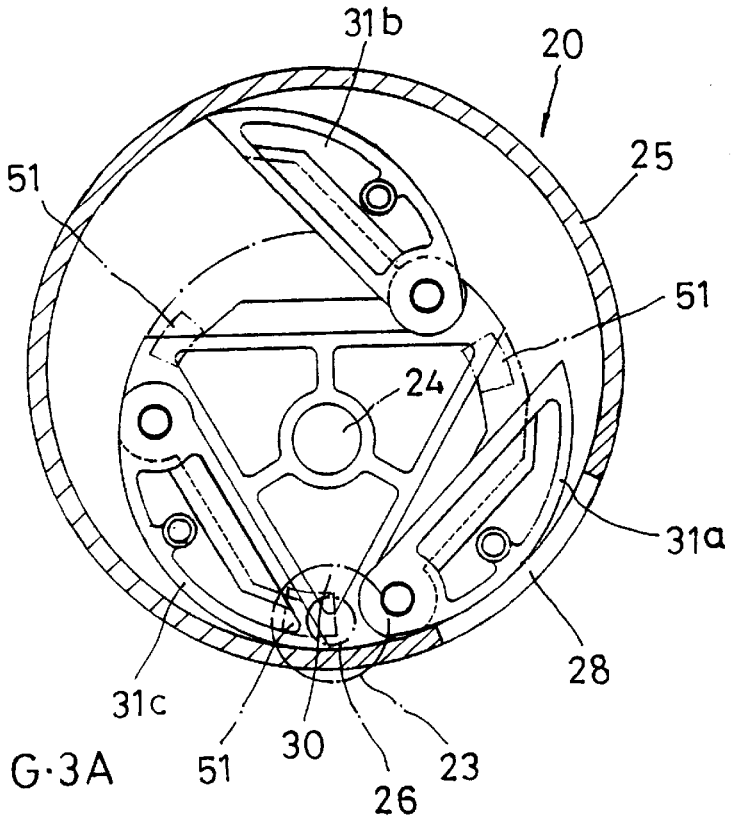
Figure 3B:
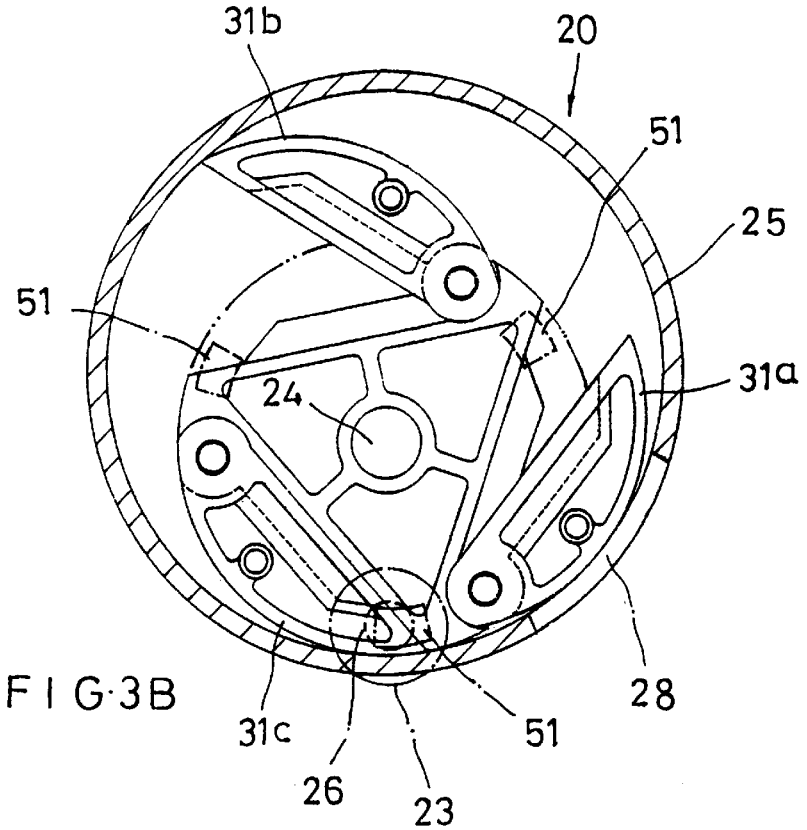
Figure 3E:
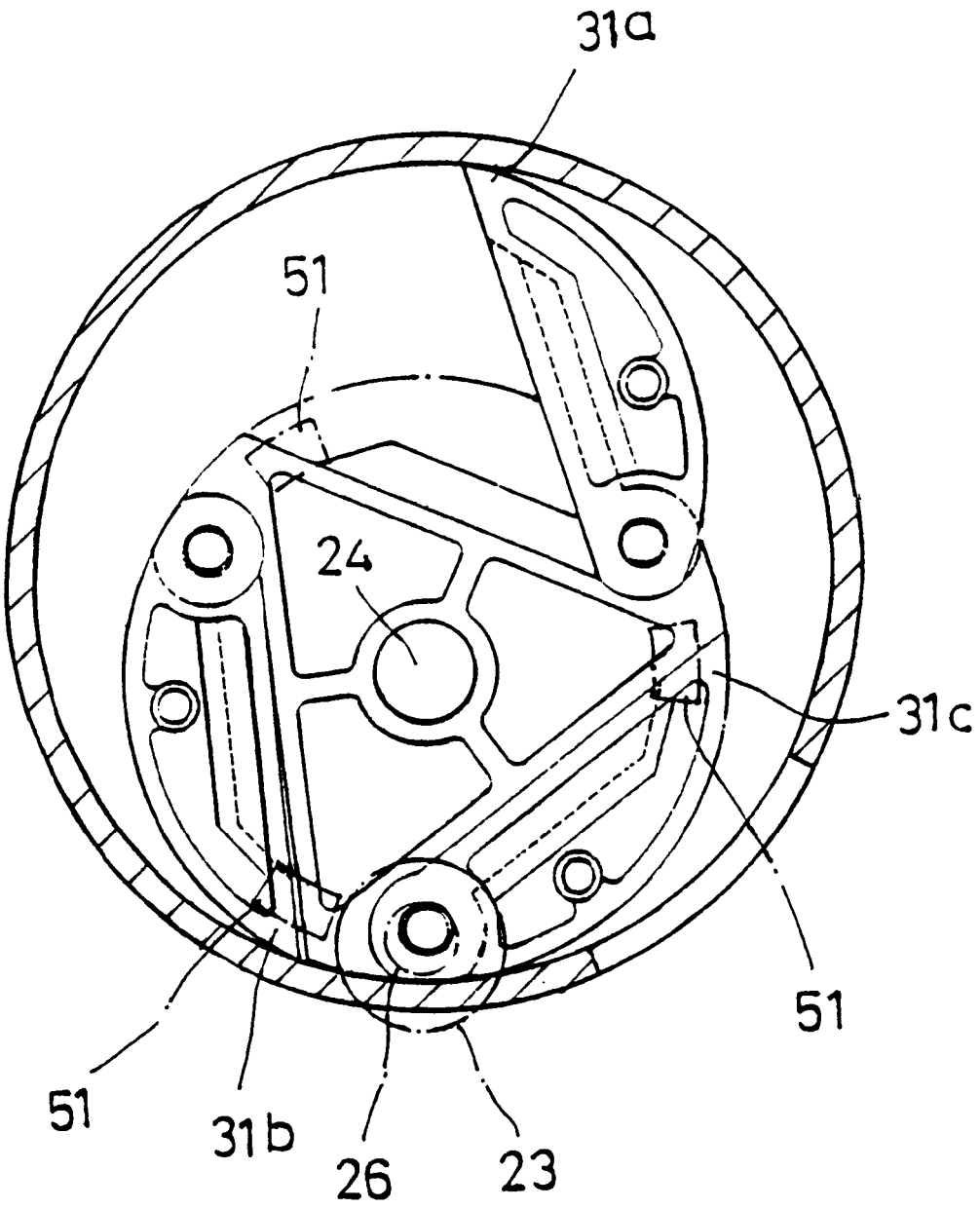

FIGS. 3A to 3E illustrate different stages of the circular motion of the first rotor 30 in the intake-compression chamber 21. In FIG. 3A, a space in the intake-compression chamber 21 in front of the blade 31*a* is communicating with an intake port 28 on the cylinder wall 25, so that outside air is admitted into this space via the intake port 28. This is an induction stroke of the rotary internal combustion engine of the present invention. Meanwhile, a space in the intake-compression chamber 21 in front of the blade 31*b* is gradually compressed by the blade 31*b* while the first rotor 30 rotates. This is a compression stroke of the rotary internal combustion engine. At this point, the blade 31*c* is in its home position of completely closely contacting with the rotor 30 and the valve hole 51 on the valve plate 50 corresponding to the blade 31*c* overlaps the intake port 26 of the combustion chamber 23, so that compressed air in the intake-compression chamber 21 is admitted into the combustion chamber 23 via the intake port 26. The compressed air is mixed with fuel in the combustion chamber 23 and the mixture is ignited and explodes. While the first rotor 30 keeps rotating, the space in front of the blade 31*a* is gradually moved away from the intake port 28 on the cylinder wall 25 and finally no longer communicates with the intake port 28, as shown in FIG. 3B. In other words, air in this space is gradually compressed. Meanwhile, the space in front of the blade 31*b* is still in the compression stroke and a space appears in front of the blade 31*c* and communicates with the intake port 28 on the cylinder wall 25. That is, the space in front of the blade 31*c* is now in the induction stroke. FIGS. 3C, 3D, and 3E sequentially illustrate the subsequent states in the intake-compression chamber 21 after the stage shown in FIG. 3B. As shown, the blade 31*b* gradually compresses the air in front of it into the combustion chamber 23. Therefore, in each turn of the first rotor 30, each of the blades 31*a*, 31*b* and 31*c* will complete one intake and one compression, and three times of ignitions and explosions will correspondingly occur in the combustion chamber 23.

Figure 7:
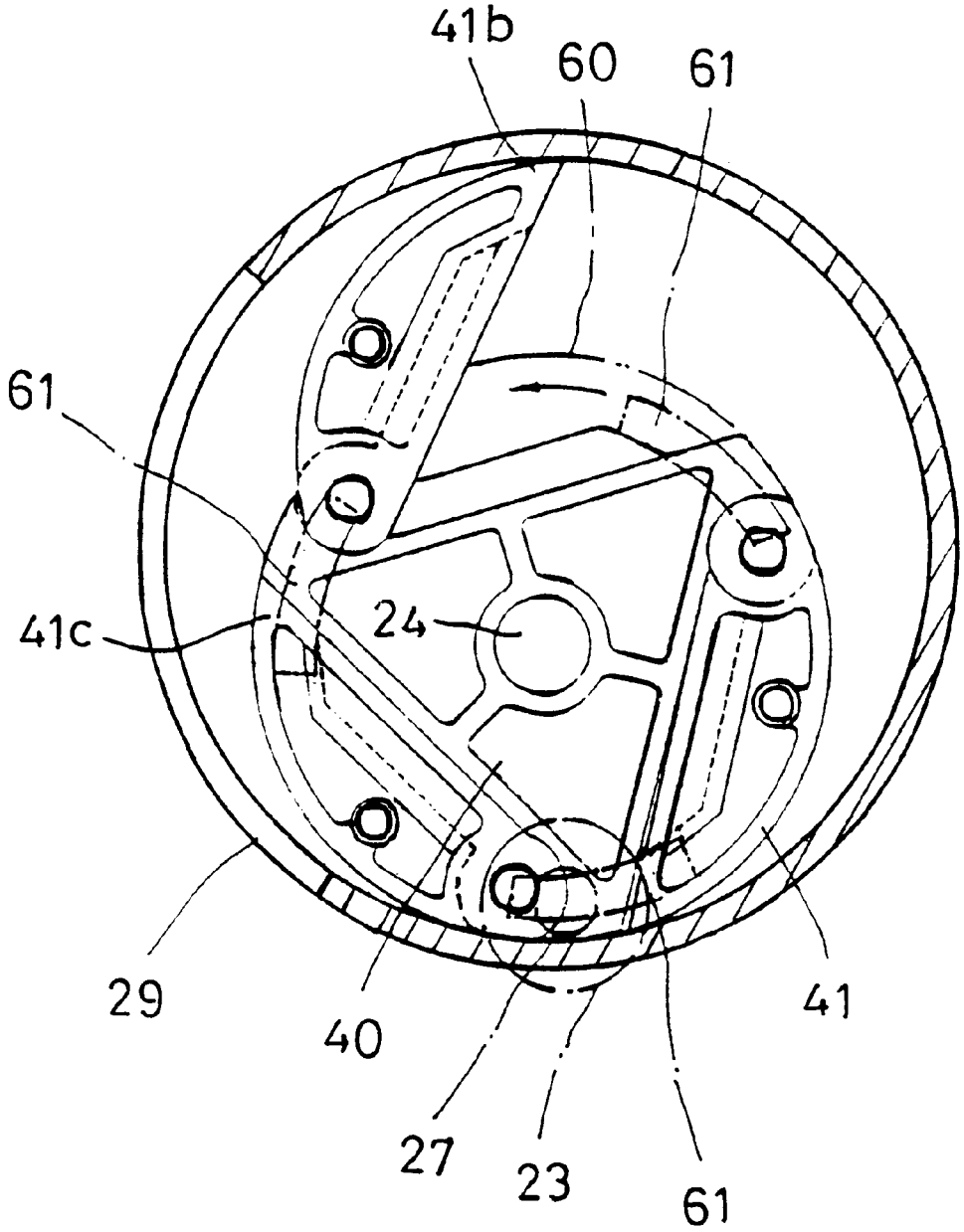
FIG. 7 illustrates the movement of a rotor in the exhaust-power chamber of the present invention.

The second rotor 40 in the exhaust-power chamber 22 is structurally similar to the first rotor 30 in the intake-compression chamber 21 but is arranged in a reverse direction. More specifically, the first rotor 30 rotates with the free ends of the blades 31*a*, 31*b*, 31*c* pointing to a direction the same as the rotational direction of the rotor 30. To the contrary, the second rotor 40 in the exhaust-power chamber 22 rotates with the pivotal ends of the blades 41*a*, 41*b*, and 41*c* pointing to a direction the same as the rotational direction of the rotor 40. The second rotational valve plate 60 in the exhaust-power chamber 22 has three valve holes 61 formed at positions corresponding to vertexes of three angles of the rotor 40. When one of the valve holes 61 on the second rotational valve plate 60 overlaps the exhaust port 27 on the combustion chamber 23, as shown in FIG. 7, exploded air-fuel mixture in the combustion chamber 23 is admitted into the exhaust-power chamber 22 via the overlapped exhaust port 27 and valve hole 61. The exploded air-fuel mixture entered the exhaust-power chamber 22 pushes the blade 41*a* and the push from the exploded air-fuel mixture is strong enough to rotate the second rotor 40 and accordingly the power output shaft 24 around which the rotor 40 is fixedly mounted. When the other two blades 41*b*, 41*c* separately and sequentially reach the position of the blade 41*a* shown in FIG. 7, they may also be pushed by the exploded air-fuel mixture released from the combustion chamber 23 into the exhaust-power chamber 22. The burned gas now loses its action force and is discharged from the cylinder 20 via an exhaust port 29 provided on the cylinder wall 25 while the second rotor 40 rotates. The intake, combustion, explosion, and exhaust occur cyclically. In each turn of the second rotor 40 in the exhaust-power chamber 22, total three times of explosion power are obtained and act. With the three times of air compression in each turn of the first rotor 30 in the intake-compression chamber 21, the three times of gas explosion in the combustion chamber 23, and the three times of action of burned and exploded gas on the second rotor 40 in the exhaust-power chamber 22, the intake, compression, explosion, and exhaust strokes in one cycle shall occur in the cylinder 20 when the power output shaft 24 turns 120 degrees.

The intake-compression chamber 21 and the exhaust-power chamber 22 of the present invention are provided with recesses at one side surface to receive the rotational valve plates 50, 60, respectively, whereby the function of the rotors 30, 40 and the blades 31*a*, 31*b*, 31*c*, 41*a*, 41*b* and 41*c* to form airtightly separated spaces in chambers 21, 22 in the course of their movements would not be obstructed by the circular movements of the rotational valve plates 50, 60. The valve holes 51 on the rotational valve plate 50 can be designed to have an opening of six degrees while the intake port 26 of the combustion chamber 23 has a designed opening of seven degrees, whereby there shall be an induce-compression-air stroke equal to thirteen degrees from the time the valve hole 51 on the rotational valve plate 50 starting to overlap the intake port 26 of the combustion chamber 23 to the time the corresponding blade 31 fully closely contacting with the main body of the first rotor 30. And, the valve holes 51 are partially located immediately behind the rotor 30, so that all the compressed air in the intake-compression chamber 21 can be compressed into the combustion chamber 23 in the course of gradual close contact of the blade 31 with the rotor 30.

On the other hand, the valve holes 61 on the rotational valve plate 60 in the exhaust-power chamber 22 can be designed to have an opening of forty-five degrees while the exhaust port 27 on the combustion chamber 23 has an opening of fifteen degrees, whereby there shall be an exploded gas release stroke equal to sixty degrees in a complete course for one valve hole 61 on the rotational valve plate 60 to pass the exhaust port 27 of the combustion chamber 23. And, the valve hole 61 each has a rear edge that is immediately behind the second rotor 40. By this way, exploded gas released from the combustion chamber 23 into the exhaust-power chamber 22 via the valve hole 61 can push only one blade 41 in front of that valve hole 61. Wherein, the second rotational valve plate 60 may have an increased thickness of 12 mm, for example. This increased thickness of the rotational plate 60 allows the exploded high-pressure and high-temperature gas in the combustion chamber 23 to be released into the exhaust-power chamber 22 to rotate the second rotor 40 so long as the valve hole 61 passing the exhaust port 27 is not completely blocked by the blade 41*a*, 41*b* or 41*c* that is gradually getting close contact with the rotor 40.

Following are some advantages of the present invention:

1. Since power from the gas explosion in the combustion chamber 23 directly rotates the second rotor 40 that has the power output shaft 24 as its central shaft, consumption of gas explosion power for mechanical transmission is minimized. Therefore, the cylinder 20 has enhanced output power.
2. Whenever the power output shaft 24 rotates 120 degrees, a cycle of four strokes is completed to output power. This enables continuous transmission of power.
3. No intake valve is needed at the intake port 28 on the cylinder wall 25 of the intake-compression chamber 21, and no exhaust valve is needed at the exhaust port 29 on the cylinder wall of the exhaust-power chamber 22. Cam shaft that controls operations of intake and exhaust ports and other related driving mechanisms all can be omitted in the present invention. And, since the power output shaft 24 moves in circular motion, it does not require any flywheel to maintain its inertia. Therefore, adjunctive accessories of the cylinder 20 can be largely simplified to reduce a gross weight of the cylinder 20.

Figure 6:
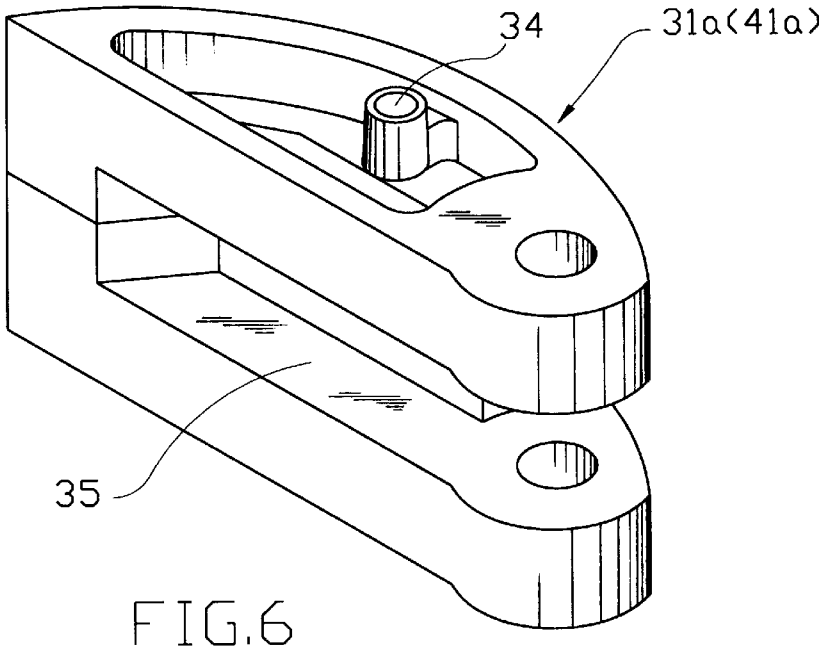
FIG. 6 is a perspective view of the blade according to the present invention.
Figure 4:
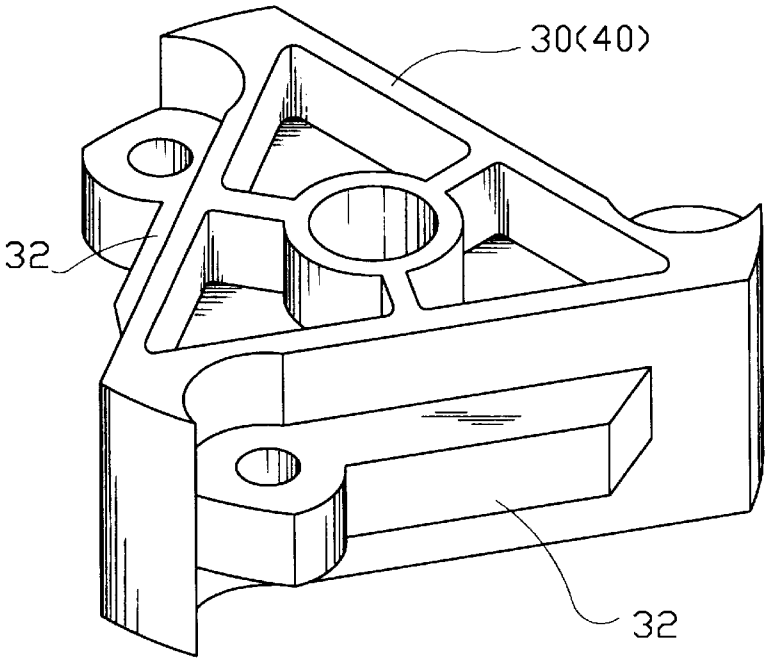
FIG. 4 is a perspective view of the rotor according to the present invention.

Please refer to FIGS. 4, 5 and 6 at the same time. Each of the blades 31*a*, 31*b*, 31*c*, 41*a*, 41*b*, and 41*c* includes an upper and a lower half. A projection 32 having a pivotal shaft at a first end thereof is provided on each of three side surfaces of the first and the second rotor 30, 40. Each of the blades 31 or 41 is connected to the rotor 30 or 40 by putting the upper and the lower halves of the blade 31 or 41 around the pivotal shaft 33 separately from an upper and a lower end thereof and extending a shaft 34 through the upper and the lower halves of the blade to enable them to move synchronously. When the upper and the lower halves of the blade 31 or 41 are fixed to the rotor 30 or 40 by the pivotal shaft 33 and bound together by the shaft 34, a recess 35 is formed between the two halves, such that when the blade 31 or 41 is in close contact with the rotor 30 or 40, the recess 35 thereof will fitly engage with the projection 32 on the rotor 30 or 40 for the blade 31 or 41 to correctly return its home position from a centrifugally thrown out position.

The numbers of blade provided on the rotors 30 and 40 are not necessarily three. There can be only one or more than one blade for each rotor. However, the blade or blades 31 or 41 must enclose the rotor 30 or 40 to form a round unit when the blade or blades 31 or 41 are in completely close contact with the rotor 30 or 40. And, the numbers of the blade 31 or 41 decide how many intake-compression-combustion-explosion-exhaust cycles in the cylinder 20 can occur in one turn of the rotor 30 or 40.

In conclusion, the above-described rotary internal combustion engine of the present invention is novel and improved because it employs principles distinctly different from that employed by conventional internal combustion engines, so that enhanced engine power and reduced engine weight are possible.

What is claimed is:

1. A rotary internal combustion engine, comprising a cylinder that is divided into an intake-compression chamber, an exhaust-power chamber, and a combustion chamber; a power output shaft transversely extending through said intake-compression chamber and said exhaust-power chamber, a first rotor and a first rotational valve plate being provided in said intake-compression chamber to fixedly mount around said power output shaft, a second rotor and a second rotational valve plate being provided in the exhaust-power chamber to fixedly mount around said power output shaft too, three first blades being separately pivotally connected at one end to vertexes of three angles of said first rotor such that they are equiangularly spaced along an outer periphery of said first rotor with another free end of each said first blades located after said pivotal end of a preceding first blade; three second blades being separately pivotally connected at one end to vertexes of three angles of said second rotor such that they are equiangularly spaced along an outer periphery of said second rotor with another free end of each said second blade located after the pivotal end of a preceding second blade; all said first and second blades having a smoothly curved outer surface, whereby when said first and second rotors rotate, the outer surfaces of these first and second blades successively come into tangent contact with inner surface of a cylinder wall in said intake-compression chamber and said exhaust-power chamber, respectively, under a centrifugal force, such tangent contact of said blade outer surfaces with said cylinder wall allowing said intake-compression chamber and said exhaust-power chamber to be respectively divided into three separated and sealed spaces; said combustion chamber being provided with an intake port to communicate with said intake-compression chamber and an exhaust port to communicate with said exhaust-power chamber; said first and said second rotational valve plates being formed of three first and second valve holes, respectively, said first and said second valve holes being so arranged that when said first and said second valve plates rotate about said power output shaft with one of said first and one of said second valve holes overlapping said intake port and said exhaust port, respectively, compressed air in said intake-compression chamber is admitted into said combustion chamber for combustion and burned and exploded gas in said combustion chamber is admitted into said exhaust-power chamber to rotate said power output shaft, respectively.

2. A rotary internal combustion engine as claimed in claim 1, wherein said power output shaft is mounted at a position offsetting from a common center line of said intake-compression chamber and said exhaust-power chamber, such that when said first or said second rotor rotates to pass by a point on said cylinder wall at where a distance between said cylinder wall and a shaft center of said first or said second rotor is shortest than at any other point on said cylinder wall, a point located at an outer end of a maximum external diameter of said first or said second rotor will come into airtightly tangent contact with said cylinder wall.

3. A rotary internal combustion engine as claimed in claim 1, wherein said smoothly curved outer surfaces of said first and said second blades enclose main bodies of said first and said second rotors, respectively, to form circular units when said first and second blades are in completely close contact with said first and said second rotors, respectively; and wherein said cylinder wall defines a maximum distance to which said first and said second blades can reach when said first and said second rotors respectively rotate in said intake-compression chamber and said exhaust-power chamber; whereby in each turn of said first and said second rotors, said free end of each of said first and said second blades is pivotally thrown out from said first or said second rotor under a centrifugal force and then returns to a home position closely contacting with said main body of said first or said second rotor in a cyclic manner.

4. A rotary internal combustion engine as claimed in claim 3, wherein when said first and said second rotor respectively rotate in said intake-compression chamber and said exhaust-power chamber, free ends of said first and said second blades of said first and said second rotor, respectively, are pivotally thrown out under a centrifugal force to tangentially contact with said cylinder wall and therefore divide said intake-compression chamber and said exhaust-power chamber into multiple separated spaces.

5. A rotary internal combustion engine as claimed in claim 1, wherein said first and said second rotational valve plates and said first and said second rotors rotate synchronously, said first and said second valve holes being separately formed at positions corresponding to points on said first and said second rotors at where said free ends of said first and said second blades closely contact with said main bodies of said first and said second rotors, respectively; and wherein a part of said first and said second valve holes on said first and said second rotational valve plates, respectively, are located immediately behind said first and said second rotors, respectively; and wherein said first and said second valve holes have chances to overlap said intake port and said exhaust port, respectively, of said combustion chamber when said first and said second rotational valve plates rotate.

6. A rotary internal combustion engine as claimed in claim 1, wherein said second rotor in said exhaust-power chamber is structurally similar to said first rotor in said intake-compression chamber but is arranged in a reverse direction, that is, said first rotor rotates with said free ends of said first blades pointing to a direction the same as a rotational direction of said first rotor while said second rotor in said exhaust-power chamber rotates with said pivotal ends of said second blades pointing to a direction the same as a rotational direction of said second rotor.

* * * * *